US006776129B2

(12) United States Patent
Diehl et al.

(10) Patent No.: US 6,776,129 B2
(45) Date of Patent: Aug. 17, 2004

(54) HYDRAULIC ACTUATOR FOR A GAS EXCHANGE VALVE

(75) Inventors: Udo Diehl, Stuttgart (DE); Karsten Mischker, Leonberg (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/450,824

(22) PCT Filed: Jul. 30, 2002

(86) PCT No.: PCT/DE02/02791

§ 371 (c)(1),
(2), (4) Date: Jun. 18, 2003

(87) PCT Pub. No.: WO03/038246

PCT Pub. Date: May 8, 2003

(65) Prior Publication Data

US 2004/0050350 A1 Mar. 18, 2004

(30) Foreign Application Priority Data

Oct. 19, 2001 (DE) ..... 101 51 773
Jun. 27, 2002 (DE) ..... 102 28 702

(51) Int. Cl.[7] ..... F01L 9/02

(52) U.S. Cl. ..... 123/90.12; 123/90.55; 123/90.13; 123/90.14; 123/90.15

(58) Field of Search ..... 123/90.12, 90.13, 123/90.14, 90.15, 90.16, 90.17, 90.18, 90.39–90.59

(56) References Cited

U.S. PATENT DOCUMENTS

| | | | | |
|---|---|---|---|---|
| 3,209,737 A | | 10/1965 | Omotehara et al. | |
| 5,758,613 A | | 6/1998 | Edelmayer et al. | |
| 5,809,950 A | * | 9/1998 | Letsche et al. | 123/90.12 |
| 6,536,388 B2 | * | 3/2003 | Lou | 123/90.12 |

FOREIGN PATENT DOCUMENTS

| | | |
|---|---|---|
| DE | 196 04 455 A1 | 8/1997 |
| DE | 198 26 047 A1 | 12/1999 |
| EP | 0 391 507 A1 | 3/1990 |
| EP | 0 751 285 A1 | 7/1996 |
| JP | 60-85209 | 5/1985 |
| SE | 353 575 | 5/1973 |

* cited by examiner

*Primary Examiner*—Jaime W Corrigan
(74) *Attorney, Agent, or Firm*—Ronald E. Greigg

(57) ABSTRACT

A hydraulic actuator for gas exchange valves of internal combustion engines is disclosed, in which the lifting of the gas exchange valve from the valve seat is effected with great force. The opening motion of the gas exchange valve then ensues at reduced force. Upon closure of the gas exchange valve, the gas exchange valve is braked before striking the valve seat, so that operation of the gas exchange valve with little wear and little noise can be achieved.

19 Claims, 4 Drawing Sheets

23
21
25
5
51
27
7
5
13
17
9
11
15
1
3
3
3
19
A4
A2
A1
A3
d5
d2
d4
d3
d6
d1
47
45
43
41
37
39
49
35
33
29
31
P

HYDRAULIC ACTUATOR FOR A GAS EXCHANGE VALVE

CROSS-REFERENCE TO RELATED APPLICATIONS

This application is a 35 USC 371 application of PCT/DE02/02791 filed on Jul. 30, 2002.

BACKGROUND OF THE INVENTION

1. Field of the Invention

The invention relates to a hydraulic actuator for a gas exchange valve for internal combustion engines.

2. Description of the Prior Art

The opening and closing of the gas exchange valve should be as fast as possible, in order to minimize flow losses from the gas exchange valve either when the combustion air is aspirated or upon expulsion of the exhaust gases from the combustion chamber.

The overpressure intermittently prevailing in the combustion chamber of the engine presses the gas exchange valve into the valve seat. Because of this overpressure, opening the gas exchange valves requires an increased expenditure of force for lifting the gas exchange valve, in particular the outlet valve, from the valve seat. Once the gas exchange valve has lifted from the valve seat, the pressure in the combustion chamber drops sharply, so that the force needed to open the gas exchange valve is correspondingly less.

Upon closure of the gas exchange valve, it must also be noted that the speed at which the valve plate of the gas exchange valve strikes the valve seat should not be excessive. If that speed is too high, unwanted noise and increased wear occur when the valve plate strikes the valve seat.

The object of the invention is to furnish a hydraulic actuator for a gas exchange valve which can exert a strong force at the onset of the opening motion on the gas exchange valve, which enables fast control motions of the gas exchange valve, and in which the gas exchange valve strikes the valve seat at low speed.

According to the invention, this object is attained by a hydraulic actuator for a gas exchange valve of an internal combustion engine, having a cylinder bore, having a piston, and having an annular piston, the piston and the annular piston being guided in the cylinder bore, and the piston, annular piston and cylinder bore define a first chamber in the axial direction whose volume increases when the actuator opens the gas exchange valve, and the annular piston and the cylinder bore define a second chamber in the axial direction whose volume decreases when the actuator opens the gas exchange valve, and the piston and the cylinder bore define a third chamber whose volume decreases when the actuator opens the gas exchange valve, and having a device for limiting the volumetric decrease of the second chamber.

SUMMARY AND ADVANTAGES OF THE INVENTION

In the hydraulic actuator of the invention, at the onset of the opening motion of the gas exchange valve, a strong hydraulic force is transmitted by the actuator to the gas exchange valve, so that despite the contrary pressure on the valve plate of the gas exchange valve from the combustion chamber, the gas exchange valve can be lifted securely and quickly from the valve seat. As soon as the force needed to actuate the gas exchange valve has decreased, for instance because there is no longer any substantial contrary pressure in the combustion chamber, the annular piston is no longer moved onward, and consequently only a lesser hydraulic force is now exerted on the piston of the actuator, and this lesser force is transmitted in turn to the gas exchange valve. With the reduction in the hydraulic force, the energy required to adjust the actuator piston is also reduced, so that the overall energy required for valve control of the engine drops. Simultaneously with the reduction in this force, the adjusting speed of the gas exchange valve also varies. Finally, upon closure of the gas exchange valve, braking of the gas exchange valve by the hydraulic actuator of the invention can be achieved before the gas exchange valve strikes the valve seat of the engine. This reduces the wear to the valve seat and gas exchange valve and also lessens the noise produced by the valve control of the engine.

The onset of the braking operation of the gas exchange valve upon its closure is moreover independent of production tolerances in the gas exchange valve and of the temperature-caused changes in length that always exist in internal combustion engines because of thermal expansion. With the actuator of the invention, highly stable operation of the engine can therefore be achieved and is affected by neither temperature expansions nor production tolerances.

In a variant of the invention, it is provided that the piston has a plunge cut; that the annular piston has a stepped center bore with one larger diameter and one smaller diameter; and that the annular piston can be slipped by the larger diameter of the center bore onto the piston, so that the ratio of the actuating forces of the actuator upon opening of the gas exchange valve and during the remaining adjusting motion is adjustable in a simple way.

This effect can be further enhanced by providing that the diameters of the piston on both sides of the plunge cut are different; and that the annular piston can be slipped onto the larger diameter.

In a further feature of the invention it is provided that the device for limiting the volumetric reduction of the second chamber is a pressure reservoir that is in communication with the second chamber and that has a piston; and that the travel of the piston is limitable, so that the annular piston can be arrested in a simple way by hydraulic means. Since the pressure reservoir does reach the high temperatures of the gas exchange valve and the cylinder head of the engine, the position in which the annular piston is arrested after the gas exchange valve has opened is independent of the thermal expansions of the gas exchange valve and of the cylinder head.

Further features of the invention provide that the pressure reservoir is a spring reservoir or a gas reservoir, and/or that the travel of the piston is limitable by a stop, in particular an adjustable stop, so that the actuator of the invention can be adjusted simply.

Further features of the invention provide that the first chamber can be made to communicate with a pump via a first switching valve; that the second chamber can be made to communicate with an oil pump via a second switching valve; and that the third chamber is acted upon by the feed pressure of the pump, so that by the actuation of two switching valves, the gas exchange valve can either be opened or closed by the hydraulic actuator of the invention, and the increased force upon liftoff of the gas exchange valve from the valve seat and the slowing down of the gas exchange valve before it strikes the valve seat can be realized automatically by the hydraulic actuator of the invention.

Separate triggering of the hydraulic actuator for that purpose is unnecessary. This makes the work of the control unit required for triggering the actuator easier, and makes the hydraulic actuator of the invention robust and insensitive to external factors.

The action according to the invention of the actuator is further reinforced by the provision that the first chamber and the second chamber are hydraulically in communication with one another via a throttle, in particular an adjustable throttle, and/or that a check valve is provided between the second chamber and the first chamber and blocks the hydraulic communication from the first chamber to the second chamber. The throttle has a definitive influence on the braking of the gas exchange valve before it strikes the valve seat.

In an advantageous embodiment of the invention, the device for limiting the volumetric decrease in the second chamber has a shutoff valve which is in communication with an opening in the second chamber and which in one switching position closes the opening and in its other switching position opens it to allow fluid to flow out. With the closure of the shutoff valve, the annular piston is fixed, so that the instant of closure of the shutoff valve defines the stroke length of the annular piston. The instant of onset of the braking action upon closure of the gas exchange valve is in turn dependent on the stroke length of the annular piston; this braking action ensues earlier with a longer stroke of the annular piston and later with a shorter stroke. Thus by means of the shutoff valve, the onset of braking can be adjusted independently of production tolerances or material expansions caused by temperature fluctuations.

In an advantageous embodiment of the invention, the shutoff valve is not used as an additional component unit; instead, its function is allocated to the second switching valve, which is required anyway to initiate the closing operation of the gas exchange valve. With the omission of the shutoff valve and by dispensing with the above-described pressure reservoir for the device for limiting the volumetric decrease in the second chamber, the construction costs for valve control are reduced.

In an advantageous embodiment of the invention, between the first chamber and the throttle disposed between the two chambers for varying the braking behavior of the actuator piston and thus of the gas exchange valve, a flow-controlled valve is provided which is embodied such that it is closable by the fluid flowing to the first chamber. This has the advantage that in the initial phase of the stroke of the actuator piston, in which both switching valves are open, fluid from the first switching valve cannot flow directly via the throttle into the hydraulic relief chamber or oil sump. It is true that if the throttling action of the throttle is strong, this flow-controlled valve can be dispensed with, since only slight quantities of fluid flow out via the throttle; however, if there is a relatively large throttle opening for the sake of attaining an only slight braking action at the gas exchange valve, then the flow-controlled valve is indispensable for blocking off the throttle, if major leakage is to be avoided.

BRIEF DESCRIPTION OF THE DRAWINGS

The invention is explained in further detail in the ensuing description of exemplary embodiments, taken in conjunction with the drawings, in which.

DESCRIPTION OF THE PREFERRED EMBODIMENT

Figure 1:
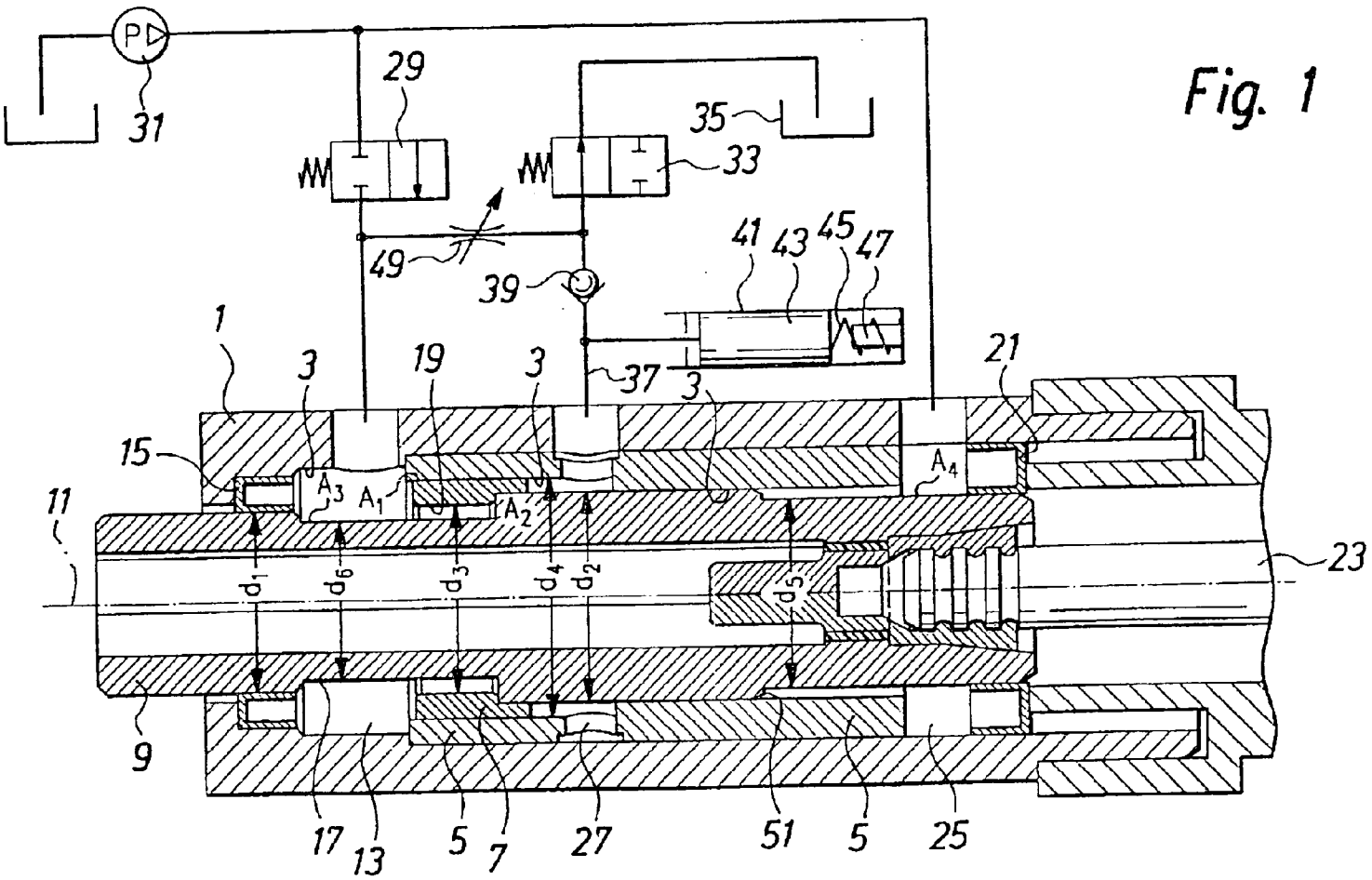
FIG. 1 is a schematic illustration of a longitudinal section through a hydraulic actuator of the invention, with its hydraulic connection.

FIG. 1 shows an exemplary embodiment of a hydraulic actuator with a housing 1 in longitudinal section. The housing 1 has a stepped cylinder bore 3. To simplify production, a sleeve 5 is press-fitted into the housing 1, and its inner bore defines part of the stepped cylinder bore 3. In the region of the sleeve 5, an annular piston 7 and a piston 9 are guided in the cylinder bore 3. In the position of the piston 9 as shown in FIG. 1, the gas exchange valve, not shown, is closed.

The cylinder bore 3, piston 9 and annular piston 7 define a first chamber 13 in the direction of a longitudinal axis 11 of the piston 9. So that no liquid or fluid can escape between the cylinder bore 3 and the piston 9, a first sealing ring 15 is disposed on the left-hand end, in terms of FIG. 1, of the first chamber 13.

The piston 9 has a plunge cut 17. The diameters of the piston 9 on opposed sides of the plunge cut 17 are of different sizes. On the side toward the sealing ring 15, the piston 9 has a smaller diameter $d_1$, and on the other end of the plunge cut 17, the piston 9 has a larger diameter $d_2$.

The annular piston 7 is disposed between the sleeve 5 and the piston 9. The annular piston 7 is fitted into the cylinder bore 3 in such a way that on the one hand it is displaceable in the axial direction, and on the other, a good sealing action is attained between the cylinder bore 3 and the annular piston 7. The annular piston 7 has a stepped center bore 19, with one smaller diameter $d_3$ and one larger diameter that is the same size as $d_2$. The fit between the annular piston 7 and the larger diameter $d_2$ of the piston 9 is likewise selected such that the annular piston 7 and the piston 9 are movable relative to one another in the axial direction, yet nevertheless a good sealing action is achieved.

On the right-hand side, in FIG. 1, of the annular piston 7, the cylinder bore 3 and the annular piston 7 define a second chamber 27. In this region, the cylinder bore 3 has a diameter $d_4$, which is equal to the outer diameter of the annular piston 7. The piston 9, on its right-hand end in terms of FIG. 1, has a shoulder with the diameter $d_5$.

On the right-hand end, in FIG. 1, of the cylinder bore 3, the annular gap between the cylinder bore 3 and the piston 9 is bridged by a second sealing ring 21 and is sealed off from the environment. On this end of the piston 9, the shaft 23 of a gas exchange valve, shown only in part, is connected by positive engagement to the piston 9.

Between the shoulder of the piston 9 having the diameter $d_5$ and the cylinder bore 3 having the diameter $d_2$, there is a third chamber 25, which is sealed off from the environment by the sealing ring 21. The annular piston 7, the part of the cylinder bore 3 having the diameter $d_4$, and the piston 9 define the second chamber 27. The first chamber 13 can be made to communicate hydraulically with a pump 31 via a first switching valve 29. The first switching valve 29 can be embodied for example as an electrically actuated magnet valve.

The pump 31 permanently subjects the third chamber 25 to the feed pressure that it generates.

By means of a second switching valve 33, embodied for example as an electrically actuated magnet valve, a hydraulic communication can be established between the second chamber 27 and a relief chamber or oil sump 35. A check valve 39 is disposed in a line 37 that connects the second chamber 27 and the second switching valve 33. A hydraulic reservoir 41 is connected between the check valve 39 and the second chamber 27. The hydraulic reservoir 41 has a piston 43, which moves counter to the force of a spring 45 when the pressure exerted on the face end of the piston 43 remote from the spring 45 is high enough. This pressure is equal to the pressure in the line 37. The travel of the piston 43 counter to the force of the spring 45 is limited by a stop 47, which may also be embodied adjustably. Between the first chamber 13 and the second chamber 27, a hydraulic communication is provided in which an adjustable throttle 49 is disposed.

When the first chamber 13 and the third chamber 25 are acted upon by the feed pressure of the pump 31, which is the case when the first switching valve 29 is open, then various hydraulic forces, which will now be described, act on the piston 9:

The diameter $d_4$ of the cylinder bore 3, the annular piston 7, and the right-hand side, in FIG. 1, of the plunge cut 17 form a first annular face $A_1$ with an outer diameter $d_4$ and an inner diameter $d_6$, the latter being equivalent to the inner diameter of the plunge cut 17. The pressure of the hydraulic fluid, located in the first chamber 13 and acting on the first annular face $A_1$, seeks to move the piston 9 to the right. The resultant force is responsible for the opening of the gas exchange valve, not shown.

The shoulder on the right-hand side, in FIG. 1, of the plunge cut 17, which is defined by the diameters $d_2$ and $d_6$, will hereinafter also be called the second annular face $A_2$.

The hydraulic force exerted on the first annular face $A_1$ is reduced by the hydraulic forces acting on a third annular face $A_3$ and a fourth annular face $A_4$.

The third annular face $A_3$ is defined by the shoulder in the piston 9 that is formed by the diameter $d_1$ of the piston 9 and by the diameter $d_6$ of the plunge cut 17. The hydraulic fluid located in the first chamber 13 exerts a force toward the left in FIG. 1 on the third annular face $A_3$.

The fourth annular face $A_4$ is defined by a shoulder 51 of the piston 9 in the region of the third chamber 25. The shoulder 51 is formed by the diameter $d_2$ and the diameter $d_5$ of the piston 9. The fourth annular face $A_4$ always exerts a force acting counter to the opening direction on the piston 9, since as already noted, the third chamber 25 is always subjected to the feed pressure of the pump 31.

Since the first annular face $A_1$ is larger than the third annular face $A_3$ and the fourth annular face $A_4$, the piston 9 moves to the right when the first chamber 13 is subjected to the feed pressure of the pump 31. The annular piston 7 transmits the hydraulic force exerted upon it to the piston 9, via the shoulder of the stepped center bore 19 of the annular piston. The motion of the piston 9 to the right in FIG. 1 results in the opening of the gas exchange valve, not shown.

When the annular piston 7 and the piston 9 move to the right in terms of FIG. 1, the volume of the second chamber 27 decreases. Since the second switching valve 33 is closed, the fluid positively displaced to the right from the second chamber 25 by the motion of the annular piston 7 and piston 9 can flow only into the hydraulic reservoir 41. The hydraulic fluid that flows into the hydraulic reservoir 41 moves the piston 43 counter to the spring 45, until the piston 43 rests on the stop 47.

Once the piston 43 rests on the stop 47, no further hydraulic fluid can flow out of the second chamber 27 into the hydraulic reservoir 41, and the result is that the volume of the second chamber 27 remains constant. This means nothing more than that the annular piston 7 can no longer move farther to the right. As a consequence, the hydraulic force that moves the piston 9 to the right decreases, since now only the hydraulic force acting on the second annular face $A_2$ is available for opening to the gas exchange valve, not shown.

The hydraulic forces described above, acting on the third annular face $A_3$ and the fourth annular face $A_4$ and which seek to move the piston to the left, that is, counter to the opening motion, remain unchanged. As a result, the opening force acting on the gas exchange valve, not shown, decreases once the gas exchange valve has lifted from the valve seat, not shown.

Figure 2A:
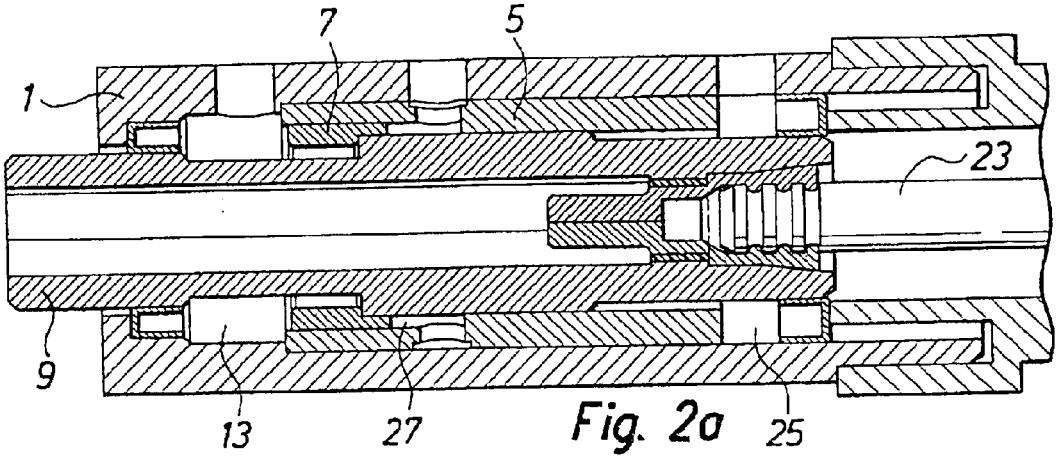
FIG. 2, a longitudinal section through the actuator of FIG. 1 in three different positions.
Figure 2B:
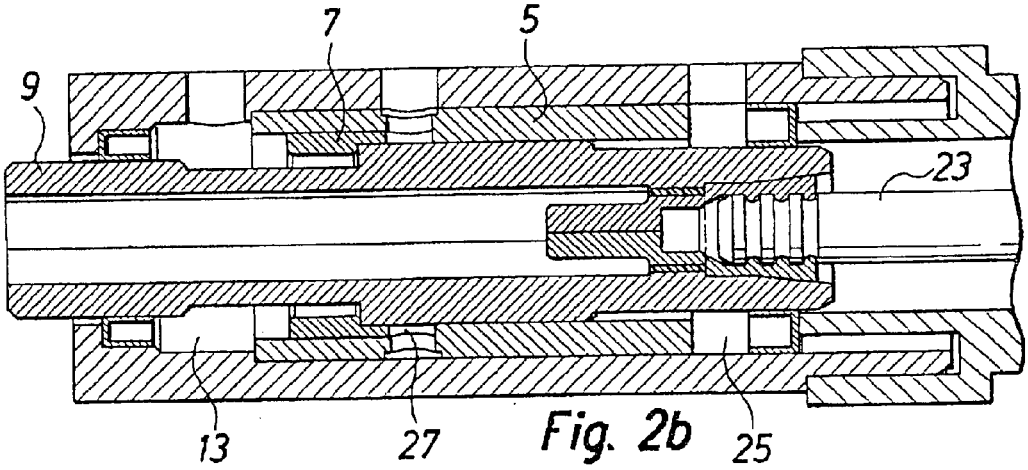
Figure 2C:
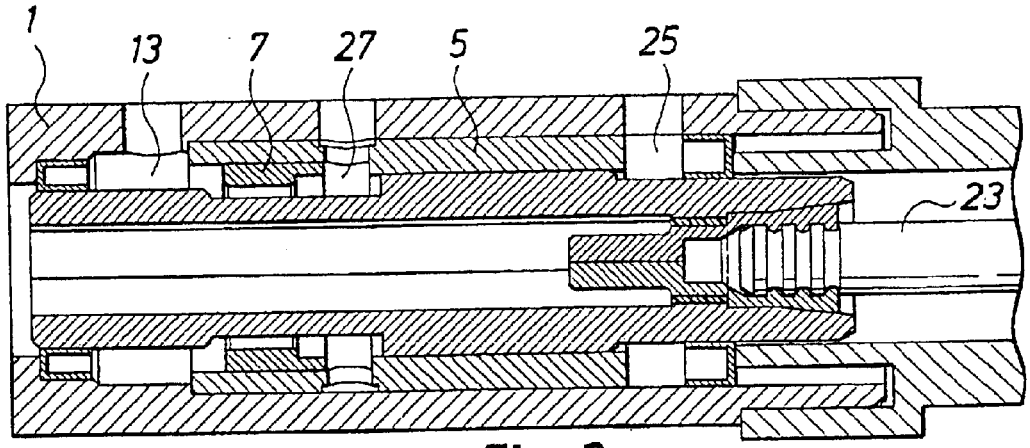

In FIGS. 2*a*, 2*b* and 2*c*, various stages in the opening motion and closing motion are shown, which are intended to illustrate what has been said above. In order not to overcomplicate the drawing, not all the reference numerals of FIG. 1 have been repeated in FIG. 2.

In FIG. 2*a*, the actuator is shown in a position in which the gas exchange valve is closed, and the full opening force is available.

In FIG. 2*b*, the state is shown in which the volume of the second chamber 27 no longer decreases, since the pressure reservoir 41, not shown in FIG. 2, does not receive any further fluid. As a consequence, the annular piston 7 no longer moves. When the gas exchange valve is opened again, the piston 9, with its diameter $d_2$, moves out of the stepped center bore 19 of the annular piston 7. From that position on, a direct hydraulic communication exists between the first chamber 13 and the second chamber 27.

This does not change the opening force at all.

In FIG. 2*c*, the hydraulic actuator is shown in a position in which the gas exchange valve is fully open, and the piston 9 has moved to the right out of the annular piston 7.

For closing the gas exchange valve, the piston 9 must be moved to the left in terms of FIGS. 1 and 2. This is accomplished by closing the first switching valve 29 and opening the second switching valve 33. This position of the switching valves 29 and 33 is shown in FIG. 1. The hydraulic force exerted on the shoulder 51 of the piston 9 by the fluid located in the third chamber 25 at the feed pressure of the pump 31 moves the piston 9 to the left. Hydraulic fluid is now pumped out of the first chamber 13 and second chamber 25 into the oil sump 35 via the check valve 39 and the second switching valve 33. In addition, the spring 45 of the hydraulic reservoir 41 is capable of lifting the piston 43 from the stop 47 and moving the piston 43 onward into its outset position.

As soon as the piston 9 plunges with its diameter $d_2$ into the stepped bore 19 of the annular piston 7, the hydraulic fluid located in the first chamber 13 can no longer reach the oil sump 35 directly via the second chamber 27 and the line 37 but must instead flow into the oil sump 35 via the throttle 49. As a result, a certain overpressure builds up in the first chamber 13 and the motion of the piston 9 is braked. As soon as the annular piston 7 rests with its stepped inner bore 19 on the piston 9, the annular piston 7 and the piston 9 move together. As a result, a greater oil volume is pumped through the throttle 49, which leads to a boosting of the braking action.

The position beyond which the desired braking of the gas exchange valve ensues before the gas exchange valve strikes the valve seat, not shown, is dependent on the stroke of the reservoir piston 43 and is thus not dependent on the thermal expansion that the hydraulic actuator is exposed to. Nor do production tolerances of the actuator affect this position. As a result of the suitable choice of the diameters $d_1$ through $d_6$, the ratios of the opening force upon liftoff of the gas exchange valve from the valve seat and the reduced opening force upon further opening of the gas exchange valve and the closing force upon closure of the gas exchange valve can be adapted to one another, in order to attain an optimal operating performance of the hydraulic actuator.

Figure 3:
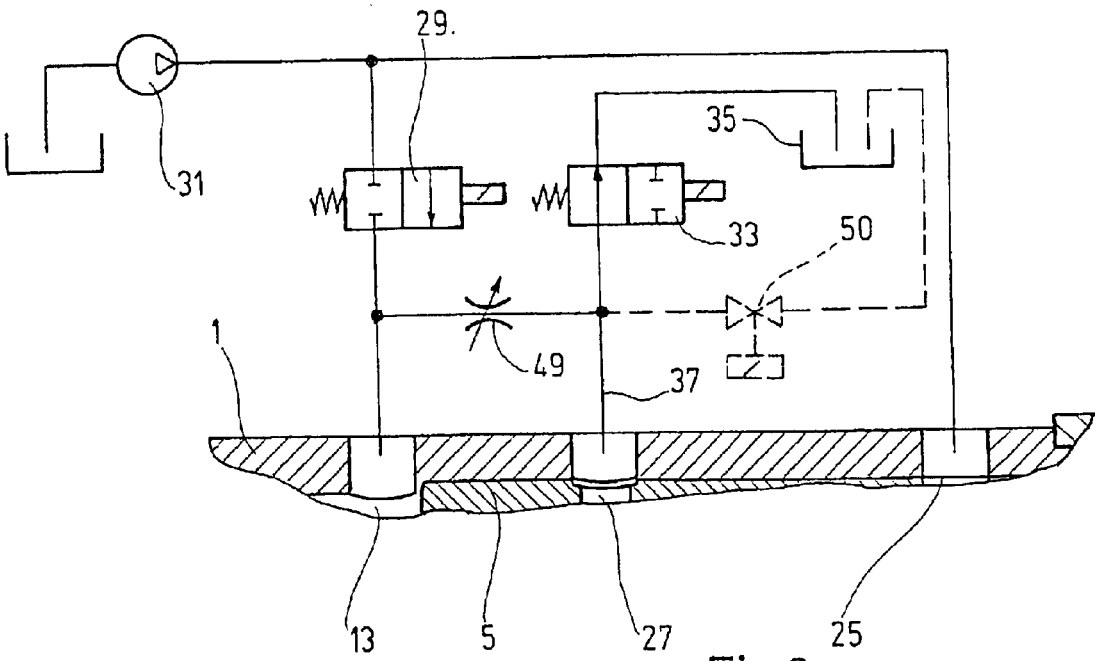
FIGS. 3 and 4, respective fragmentary longitudinal sections through the actuator of FIG. 1 with a variously modified hydraulic connection.

In FIG. 3, the actuator of FIG. 1 is shown in fragmentary form, only to the extent of interest below, with the housing 1, first chamber 13, second chamber 27 and third chamber 25, and with its hydraulic connection to the hydraulic pump 31 with the first switching valve 29, embodied for instance as a 2/2-way magnet valve, and the hydraulic communication between the first chamber 13 and second chamber 27 via the throttle 49. The hydraulic relief chamber or oil sump is identified, as before, by reference numeral 35, and the line connecting the second chamber 27 with the second switching valve 33, embodied for instance as a 2/2-way magnet valve, is identified by reference numeral 37. The hydraulic actuator has been modified to the extent that the device for limiting the volumetric decrease of the second chamber 27, which in FIG. 1 is embodied as a hydraulic spring reservoir 41, is now replaced with a shutoff valve 50, which is in communication with an opening in the second chamber 27, for instance being connected to the line 37, and in one switching position it closes the opening in the second chamber 27, or the connection to the line 37, while in its other switching position it opens it so that fluid can flow out to the oil sump 35. The function of this shutoff valve 50, represented only symbolically in FIG. 3, is, however, assigned to the second switching valve 33, which to enable fluid to flow out of the second chamber 27 is in the basic position shown in FIG. 3 and which is switched over to its other switching position in order to block off the second chamber 27. The switchover valve 33 furthermore maintains its function, already described in conjunction with FIG. 1, for the closure of the gas exchange valve without modification.

As described above, to open the gas exchange valve the first switching valve 29 must be opened. Fluid now flows at the feed pressure into the chamber 13, so that the piston 9 of the actuator is displaced together with the annular piston 7 as shown in FIG. 2*b*. If at an arbitrary instant during the displacement of the annular piston 7 the second switching valve is switched over to its blocking position, then fluid cannot flow out of the second chamber 27, and the annular piston 7 is blocked. The stroke of the annular piston 7 is accordingly defined by the instant of switchover of the second switchover valve 33, which at the onset of the opening motion of the actuator is open.

As described above, to close the gas exchange valve, the annular piston 7 is displaced back again by the pressure in the third valve chamber 25, as soon as the first switching valve 29 is blocked again and the second switching valve 33 is opened again. In the process, the pressure in the first chamber 13 decreases via the throttle 49. After a stroke travel, the piston 9 strikes and carries the annular piston 7 along with it in its further stroke course. As a result, a high volumetric current and a pronounced pressure increase in the first chamber 13 are caused, so that the piston 9 is braked sharply. The braking action begins at the instant when the annular piston 7 moves jointly with the piston 9, so that the instant of onset of the braking operation is defined by the stroke travel of the annular piston 7, which is established in the opening process of the gas exchange valve. Thus by means of the instant of switchover of the second switching valve 33 into its blocking position upon opening of the gas exchange valve, the instant of onset of the braking event upon closure of the gas exchange valve can be defined.

Figure 4:
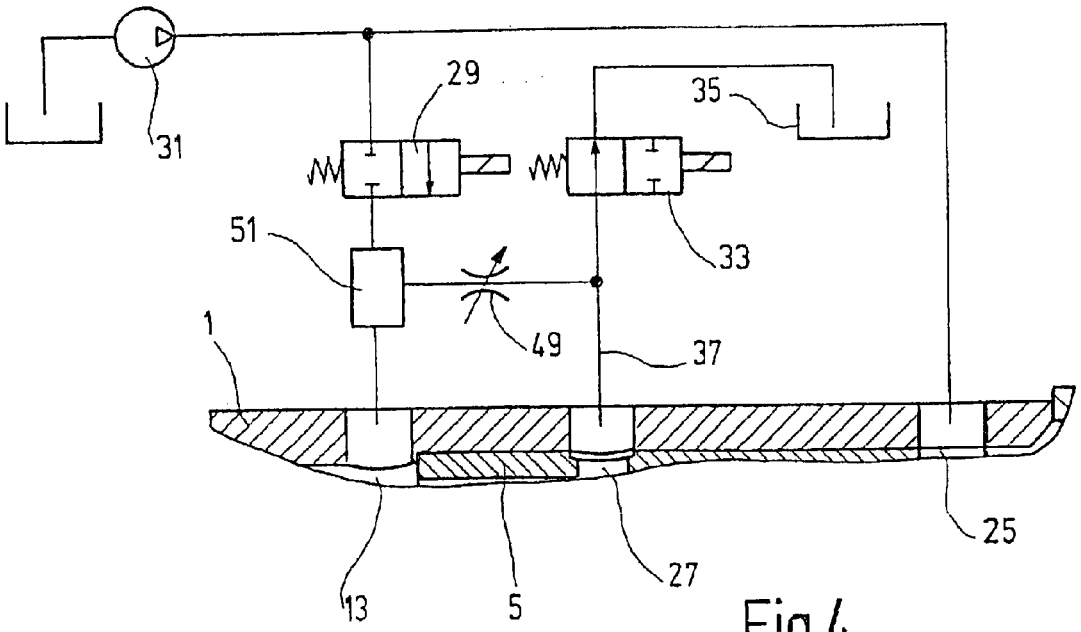

The exemplary embodiment, shown in fragmentary form in FIG. 4, of the actuator with hydraulic connection is modified compared to FIG. 3 only to the extent that between the first chamber 13 in the housing 1 and the throttle 49 in the connecting line to the second chamber 27 in the housing 1, a flow-controlled valve 51 has been incorporated, which is embodied such that it is closable by the fluid flowing to the first chamber 13. This flow-controlled valve 51 prevents fluid, in the initial phase for opening the gas exchange valve, in which phase both the first switching valve 29 and the second switching valve 33 are open, from flowing directly from the first switching valve 29 out to the oil sump 35 via the second switching valve 33; this is because the leakage flowing via the throttle 49 increases the energy requirement for valve control, if it increases unacceptably. That is the case particularly whenever the braking action upon the closure of the gas exchange valve is to be lowered moderately by means of a wider opening of the throttle 49. If the first switching valve 29 is opened, then as a result of the fluid flowing from the hydraulic pump 31 into the first chamber 13, the valve 51 is closed, and the communication with the throttle 49 is thus blocked. If the first switching valve 29 is closed, or in other words has been returned to the switching position shown in FIG. 4, then the valve 51 opens, and the requisite communication for expelling the fluid from the first chamber 13 via the throttle 49 upon the closing of the gas exchange valve is reestablished.

Figure 5:
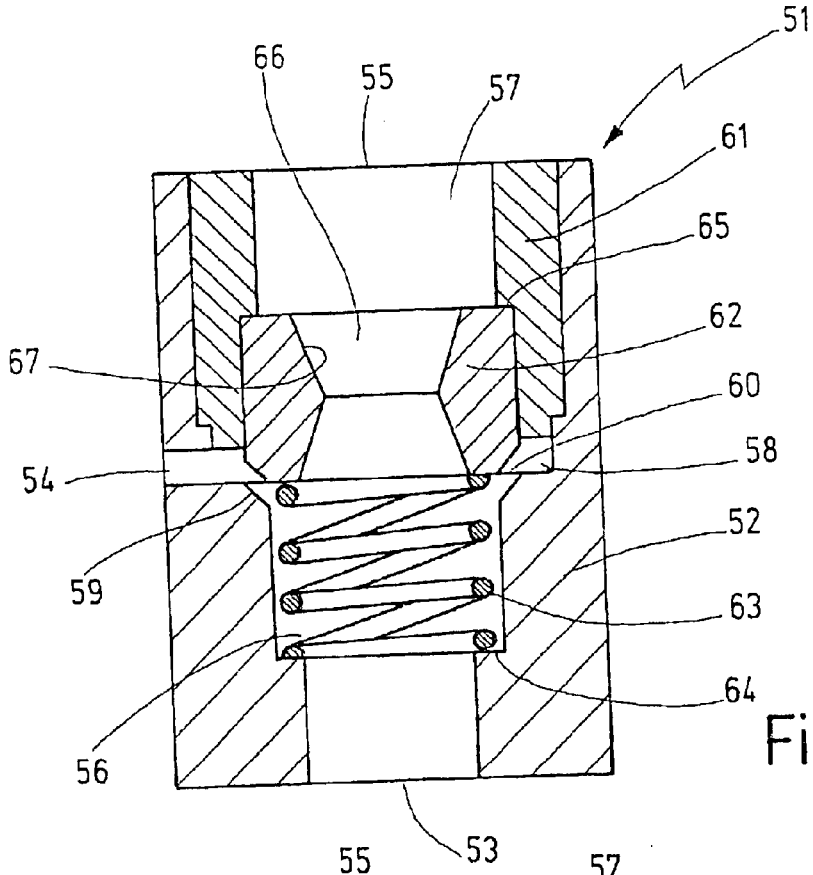
FIGS. 5 and 6, respective longitudinal sections through a flow-controlled valve of FIG. 4, in the open state (FIG. 5) and in the closed state (FIG. 6).
Figure 6:
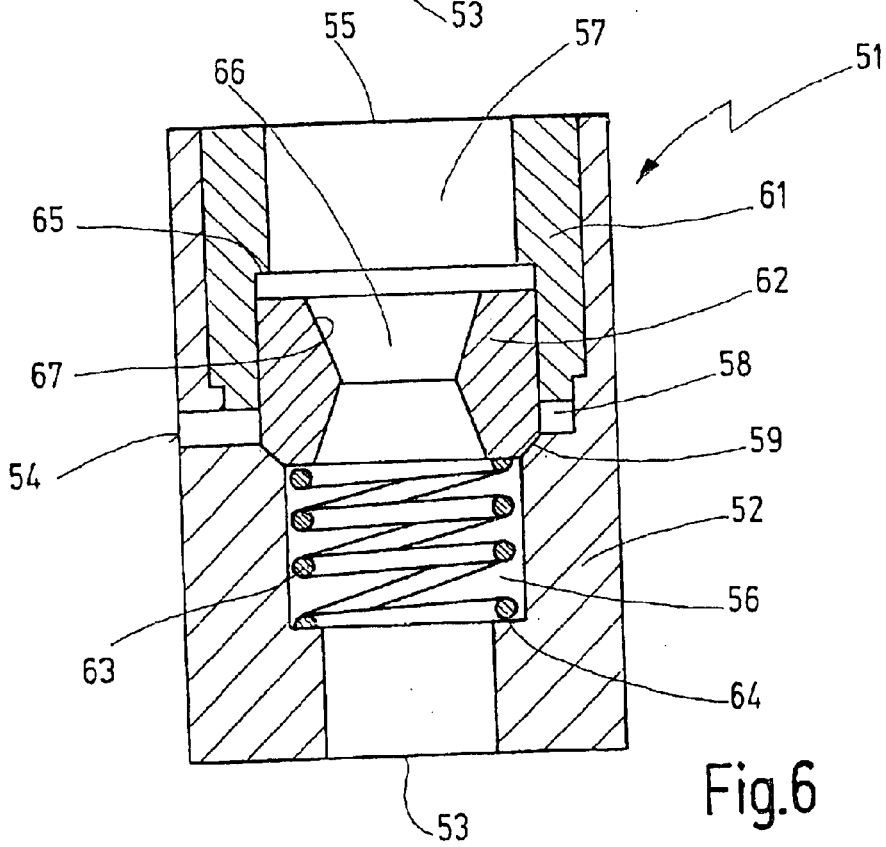

The layout of the flow-controlled valve 51 is shown schematically in FIGS. 5 and 6; FIG. 5 shows the valve open, and FIG. 6 shows the valve closed. The flow-controlled valve 51 has a housing 52, with a first valve connection 53 communicating with the chamber 13 of the actuator, a second valve connection 54 connected to the throttle 49, and a third valve connection 55 communicating with the outlet of the first switching valve 29. The first valve connection 53 communicates with a lower valve chamber 56, the third valve connection 55 communicates with an upper valve chamber 57, and the second valve connection 54 communicates with an annular chamber 58 located between the lower and upper valve chambers 56, 57. Between the lower valve chamber 56 and the annular chamber 58, a valve opening 60 surrounded by a valve seat 59 is embodied in the housing 52. A guide sleeve 61 is inserted into the upper valve chamber 57, and a valve member 62 embodied as a valve displacement piston is guided displaceably in this guide sleeve. The valve member 62 cooperates with the valve seat 59 to close and open the valve opening 60, so that the annular chamber 58 is blocked off from the lower valve chamber 56 when the valve member 62 is seated on the valve seat 59 (FIG. 6), and communicates with the lower valve chamber 56 when the valve member 62 has lifted from the valve seat 59 (FIG. 5). A valve opening spring 63 is placed in the lower valve chamber 56; it is embodied as a compression spring and braced on one end on a shoulder 64 embodied in the lower valve chamber 56 and on the other end on the valve member 62. The valve opening spring 63 presses the valve member 62 against a stop 65 embodied in the guide sleeve 61.

The valve member 62 is provided with a central through opening 66, which permanently connects the upper valve chamber 57 with the lower valve chamber 56. The through opening 66 is embodied as a throttle, and for that purpose its inner contour 67 has a design such that the fluid flowing from the upper valve chamber 57 to the lower valve chamber 56 causes a pressure drop in the through opening 66. In the exemplary embodiment of FIGS. 5 and 6, the through opening 66 has the form of a double truncated cone for this purpose, in which two truncated cones are placed on one another with their smaller bases.

If the first switching valve 29 is opened for the sake of opening the gas exchange valve, fluid flows from the outlet of the pump 31 through the through opening 66 in the valve member 62, and because of the inner contour 67, a pressure drop occurs between the upper and lower valve chambers 57, 56. Thus the pressure in the upper valve chamber 57 is greater than in the lower valve chamber 56, and at the valve member there is a resultant displacement force, which counter to the spring force of the valve opening spring 63 seats the valve member 62 on the valve seat 59 and thus closes the valve opening 60, as a result of which the communication with the throttle 49 is blocked.

If the first switching valve 29 is opened again, then no further fluid flows via the through opening 66. No pressure drop occurs at the inner contour 67, and so the pressures in the lower valve chamber 56 and in the upper valve chamber 57 are equal. The force acting on the valve member 62 is zero, and by means of the spring force of the valve opening spring 63, the valve member 62 is pressed against the stop 65 in the guide sleeve 61. The valve member 62 is thus lifted from the valve seat 59, and the first chamber 13 of the actuator now communicates with the throttle 49. Upon closure of the gas exchange valve, the fluid volume positively displaced from the first chamber 13 as a result of the displacement motion of the pistons 9 and 7 can now flow out into the oil sump 35, via the throttle 49 and the opened second switching valve 33.

The foregoing relates to preferred exemplary embodiments of the invention, it being understood that other variants and embodiments thereof are possible within the spirit and scope of the invention, the latter being defined by the appended claims.

What is claimed is:

1. A hydraulic actuator for a gas exchange valve of an internal combustion engine, comprising a cylinder bore (3), a piston (9), an annular piston (7), the piston (9) and the annular piston (7) being guided in the cylinder bore (3);

the piston (9), annular piston (7) and cylinder bore (3) defining a first chamber (13) in the axial direction whose volume increases when the actuator (1) opens the gas exchange valve (23), the annular piston (7) and the cylinder bore (3) defining a second chamber (27) in the axial direction whose volume decreases when the actuator (1) opens the gas exchange valve (23);

the piston (9) and the cylinder bore (3) defining a third chamber (25) whose volume decreases when the actuator (1) opens the gas exchange valve (23), and a device for limiting the volumetric decrease of the second chamber (27).

2. The actuator of claim 1, wherein the piston (9) comprises a plunge cut (17); wherein the annular piston (7) comprises a stepped center bore (19) with one larger diameter ($d_2$) and one smaller diameter ($d_3$); and wherein the annular piston (7) can be slipped by the larger diameter ($d_2$) of the center bore (19) onto the piston (9).

3. The actuator of claim 2, wherein the diameters ($d_1$, $d_2$) of the piston (9) on both sides of the plunge cut (17) are different; and wherein the annular piston (7) can be slipped onto the larger diameter ($d_2$).

4. The actuator of claim 1, wherein the third (25) communicates directly, and the first chamber (13) communicates via a first switching valve (29), with the outlet of a pump (31) that generates feed pressure, and wherein the second chamber (27) communicates via a second switching valve (33) with a relief chamber (35) that receives fluid.

5. The actuator of claim 4, wherein the device for limiting the volumetric decrease in the second chamber (27) comprises a shutoff valve (50) which is in communication with an opening in the second chamber (27) and which in one switching position closes the opening and in its other switching position opens it to allow fluid to flow out, and wherein the shutoff valve is formed by the second switching valve (33).

6. The actuator of claim 1, wherein the device for limiting the volumetric decrease of the second chamber (27) comprises a pressure reservoir (41) that is in communication with the second chamber (27) and has a piston (43); and wherein the travel of the piston is limitable.

7. The actuator of claim 6, wherein the pressure reservoir (41) is a spring reservoir (45) or a gas reservoir.

8. The actuator of claim 7, wherein the travel of the piston (43) is limitable by means of a stop, in particular an adjustable stop (47).

9. The actuator of claim 6, wherein the travel of the piston (43) is limitable by means of a stop, in particular an adjustable stop (47).

10. The actuator of claim 1, wherein the device for limiting the volumetric decrease in the second chamber (27) comprises a shutoff valve (50) which is in communication with an opening in the second chamber (27) and which in one switching position closes the opening and in its other switching position opens it to allow fluid to flow out.

11. The actuator of claim 1, wherein the first chamber (13) and the second chamber (27) communicate with one another via a throttle, in particular an adjustable throttle (49).

12. The actuator of claim 11, further comprising a flow-controlled valve (51) disposed between the first chamber (13) and the throttle (49), the flow-controlled valve (51) being embodied such that it is normally open and can be closed by the fluid flowing to the first chamber (13).

13. The actuator of claim 12, wherein the flow-controlled valve (51) comprises a housing (52) with a first valve chamber (56) in communication with the chamber (13), a second valve chamber (58) in communication with the throttle (49), a third valve chamber (57) in communication with the first switching valve (29), and a valve opening (60), disposed between the first and second valve chambers (56, 58) and surrounded by a valve seat (59), the flow-controlled valve (51) also comprising a valve member (62), which defines the third valve chamber (57) and is axially displaceable in the housing and which cooperates with the valve seat (59) for closing and opening the valve opening (60), and a throttle opening (66), embodied in the valve member (62), which connects the first and third valve chambers (56, 57) with one another.

14. The actuator of claim 13, wherein the throttle (49) is formed by the inner contour (67) of a central through opening (66) made in the valve member (62), which opening has an inner contour (67) designed such that the fluid flowing from the third valve chamber (57) into the first valve chamber (56) causes a pressure drop at the valve member (62).

15. The actuator of claim 14, wherein the inner contour (67) of the through opening (66) and the valve opening spring (63) are adapted to one another in such a way that the displacement force exerted on the valve member (62) as a result of the pressure difference is greater than the contrary force of a valve opening spring (63).

16. The actuator of claim 15, wherein the through opening (66) has the form of a double truncated cone, in which two coaxial truncated cones stand with their smaller bases on one another.

17. The actuator of claim 14, wherein the through opening (66) has the form of a double truncated cone, in which two coaxial truncated cones stand with their smaller bases on one another.

18. The actuator of claim 13, wherein the through opening (66) has the form of a double truncated cone, in which two coaxial truncated cones stand with their smaller bases on one another.

19. The actuator of claim 1, further comprising a check valve (39) between the second chamber (27) and the first chamber (13), the check valve (39) blocking the communication from the first chamber (13) to the second chamber (27).

* * * * *